US008360823B2

(12) United States Patent
Gagliardi

(10) Patent No.: US 8,360,823 B2
(45) Date of Patent: Jan. 29, 2013

(54) SPLICING TECHNIQUE FOR FIXED ABRASIVES USED IN CHEMICAL MECHANICAL PLANARIZATION

(75) Inventor: John J. Gagliardi, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 340 days.

(21) Appl. No.: 12/815,764

(22) Filed: Jun. 15, 2010

(65) Prior Publication Data

US 2011/0306276 A1 Dec. 15, 2011

(51) Int. Cl.
*B24B 1/00* (2006.01)
*B24B 33/00* (2006.01)

(52) U.S. Cl. ..... 451/28; 451/540

(58) Field of Classification Search ..... 451/41, 451/59, 527, 529, 533, 538, 539, 531
See application file for complete search history.

(56) References Cited

U.S. PATENT DOCUMENTS

| | | | | | |
|---|---|---|---|---|---|
| 1,924,773 | A | * | 8/1933 | Doermann | 451/548 |
| 2,242,877 | A | * | 5/1941 | Albertson | 451/527 |
| 2,685,155 | A | * | 8/1954 | Kuzma et al. | 451/533 |
| 3,568,371 | A | * | 3/1971 | Day et al. | 451/324 |
| 3,729,873 | A | * | 5/1973 | Sandell | 451/531 |
| 3,763,604 | A | * | 10/1973 | Malloy | 451/531 |
| 4,215,516 | A | * | 8/1980 | Huschle et al. | 451/531 |
| 4,314,827 | A | | 2/1982 | Leitheiser et al. | |
| 4,623,364 | A | | 11/1986 | Cottringer et al. | |
| 4,744,802 | A | | 5/1988 | Schwabel | |
| 4,770,671 | A | | 9/1988 | Monroe et al. | |
| 4,881,951 | A | | 11/1989 | Monroe et al. | |
| 5,152,917 | A | | 10/1992 | Pieper et al. | |
| 5,256,227 | A | * | 10/1993 | Roelofs | 156/157 |
| 5,584,897 | A | * | 12/1996 | Christianson et al. | 51/295 |
| 5,593,537 | A | * | 1/1997 | Cote et al. | 438/692 |
| 5,840,141 | A | * | 11/1998 | Korbel | 156/153 |
| 6,062,958 | A | * | 5/2000 | Wright et al. | 451/288 |
| 6,149,506 | A | * | 11/2000 | Duescher | 451/59 |
| 6,312,325 | B1 | * | 11/2001 | Van Osenbruggen | 451/548 |
| 6,371,840 | B1 | * | 4/2002 | Ball et al. | 451/364 |
| 6,453,899 | B1 | * | 9/2002 | Tselesin | 125/15 |
| 6,585,579 | B2 | * | 7/2003 | Jensen et al. | 451/527 |
| 6,761,620 | B2 | * | 7/2004 | Naujok | 451/41 |
| 6,786,810 | B2 | * | 9/2004 | Muilenburg et al. | 451/296 |
| 6,835,118 | B2 | * | 12/2004 | Berkstresser et al. | 451/28 |
| 7,004,823 | B2 | * | 2/2006 | Kisbøll et al. | 451/57 |
| 7,604,530 | B2 | * | 10/2009 | Shih | 451/527 |
| 7,841,925 | B2 | * | 11/2010 | Menk et al. | 451/6 |
| 2002/0058468 | A1 | * | 5/2002 | Eppert, Jr. et al. | 451/489 |
| 2004/0018805 | A1 | * | 1/2004 | Pham | 451/56 |
| 2004/0137831 | A1 | | 7/2004 | Kollodge et al. | |
| 2006/0003675 | A1 | | 1/2006 | Chopra et al. | |
| 2006/0148385 | A1 | * | 7/2006 | Phang et al. | 451/41 |
| 2006/0252352 | A1 | * | 11/2006 | Jeng et al. | 451/8 |
| 2007/0026770 | A1 | | 2/2007 | Fletcher et al. | |
| 2007/0128991 | A1 | | 6/2007 | Yoon et al. | |

* cited by examiner

*Primary Examiner* — Lee D Wilson
*Assistant Examiner* — Marc Carlson
(74) *Attorney, Agent, or Firm* — Ann K. Gallagher

(57) ABSTRACT

An abrasive article includes a support pad, a first abrasive element, a second abrasive element and a fixation mechanism. The support pad has a first major surface, a second major surface, a first edge, a second edge and a channel. The channel is formed within the first major surface and extends from the first edge to the second edge. The first and second abrasive elements are each positionable over a portion of the support pad. The fixation mechanism is positioned within the channel ad secures an edge of the first abrasive element and an edge of the second abrasive element to the support pad.

20 Claims, 2 Drawing Sheets

SPLICING TECHNIQUE FOR FIXED ABRASIVES USED IN CHEMICAL MECHANICAL PLANARIZATION

FIELD OF THE INVENTION

The present invention is related generally to the field of chemical mechanical planarization (CMP). In particular, the present invention is a technique for simulating a splice for edges of fixed abrasives for use in a CMP process.

BACKGROUND

Fixed abrasives are commonly used in chemical mechanical planarization (CMP) processes because they provide consistent planarity, high substrate removal rates, and low levels of nonuniformity and defects. In the field of semiconductors, it is well known that polishing a wafer, for example, over the edges of a fixed abrasive article may result in high defect levels on the wafer being polished. These defects can occur when the diameter of the fixed abrasive article is smaller than the diameter of the platen that the fixed abrasive article is positioned on. The defects can be in the form of scratches caused by the relatively rough and uneven edges of the fixed abrasive article contacting the wafer. Conventional solutions include either splicing the edges of two separate, fixed abrasive articles together or splicing two edges of a single fixed abrasive article together in order to cover the entire platen.

SUMMARY

In one embodiment, the present invention is an abrasive article including a support pad, a first abrasive element, a second abrasive element and a fixation mechanism. The support pad has a first major surface, a second major surface, a first edge, a second edge and a channel. The channel is formed within the first major surface and extends from the first edge to the second edge. The first and second abrasive elements are each positionable over a portion of the support pad. The fixation mechanism is positioned within the channel and secures an edge of the first abrasive element and an edge of the second abrasive element to the support pad.

In another embodiment, the present invention is a fixed abrasive article including a pad, a first abrasive element, a second abrasive element and a fixation mechanism. The pad has a first major surface and a second major surface. The first and second abrasive elements are each positionable over a portion of the first major surface. The fixation mechanism is located below a plane defined by the first major surface and attaches an edge of the first abrasive element and an edge of the second abrasive element to the pad.

In yet another embodiment, the present invention is a method of polishing a surface of a workpiece. The method includes providing a support pad having a first major surface, a first edge, a second edge, and a channel located within the first major surface extending from the first edge to the second edge, covering the first major surface of the support pad with a first abrasive element and a second abrasive element, positioning an edge of each of the first and second abrasive elements within the channel of the support pad, maintaining the edges of the first and second abrasive elements within the channel, contacting the first and second abrasive elements with the surface of the workpiece and moving the workpiece and the fixed abrasive elements with respect to each other.

BRIEF DESCRIPTION OF THE DRAWINGS

The invention will be more readily understood and other features and advantages thereof will appear more clearly with reference to the accompanying drawings, given solely by way of example, in which.

DETAILED DESCRIPTION

Figure 1:
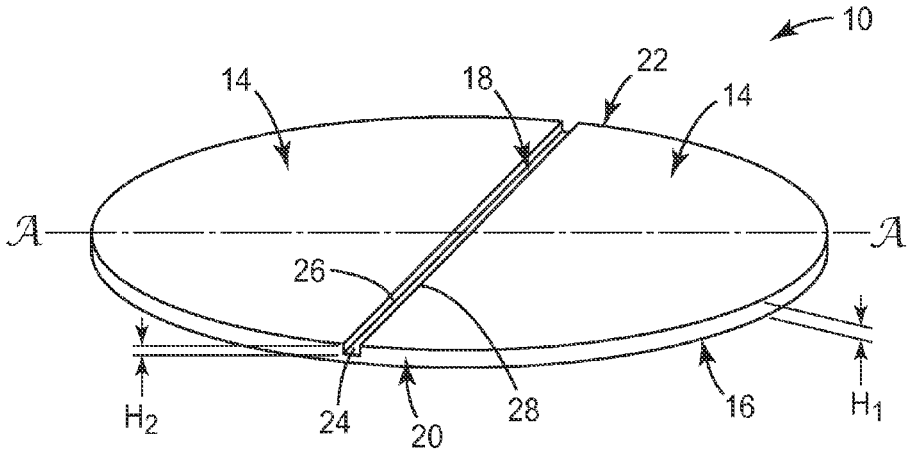
FIG. 1 is a top view of a support pad in accordance with the present invention.

FIG. 1 shows a top view of a support pad 10, such as a pad or a sub-pad for use in a chemical mechanical planarization (CMP) process. The support pad 10 forms part of a fixed abrasive construction 12 (shown in FIGS. 2, 3, 4 and 5 as abrasive articles 12*a*, 12*b*, 12*c* and 12*d*) of the present invention that can be used to polish or planarize a semiconductor wafer, for example. For simplicity, when referring to fixed abrasive articles of the present invention in general, the reference number 12 will be used. When referring to a particular embodiment of a fixed abrasive article, the appropriate reference number 12*a*, 12*b*, 12*c* and 12*d* will be used. Although the fixed abrasive constructions 12 of the present invention are particularly suitable for use with processed semiconductor wafers (i.e., patterned semiconductor wafers with circuitry thereon, or blanket, non-patterned wafers), they can be used with unprocessed or blank (e.g., silicon) wafers without departing from the intended scope of the present invention.

The support pad 10 has a first major surface 14, a second major surface 16 and a channel 18 extending from a first edge 20 to a second edge 22 opposite the first edge 20. The channel 18 is formed within the first major surface 14 and includes a floor 24, a first side wall 26 and second side wall 28. The channel 18 results in the support pad 10 having a first height $H_1$ and a second height $H_2$. The first height $H_1$ is measured from a plane of the second major surface 16 to a plane of the first major surface 14. The second height $H_2$ is measured from a plane of the first major surface 14 to a plane of the floor 24 of the channel 18. The second height $H_2$ is thus shorter than the first height $H_1$. In one embodiment, the first height $H_1$ is about 90 micrometers and the second height $H_2$ is about 60 micrometers. Although FIG. 1 depicts the channel 18 as dividing the support pad 10 substantially in half, the channel 18 may extend from any respective edges of the support pad 10 without departing from the intended scope of the invention as long as the fixed abrasive elements 30 and 32 (shown in FIGS. 2, 3, 4 and 5) cover the two major surface areas created by the channel 18. In addition, although FIG. 1 depicts the support pad 10 as having a substantially circular shape, the support pad 10 may take other shapes without departing from the intended scope of the present invention. For example, the support pad 10 may be rectangular, square, oval and the like.

Figure 2:
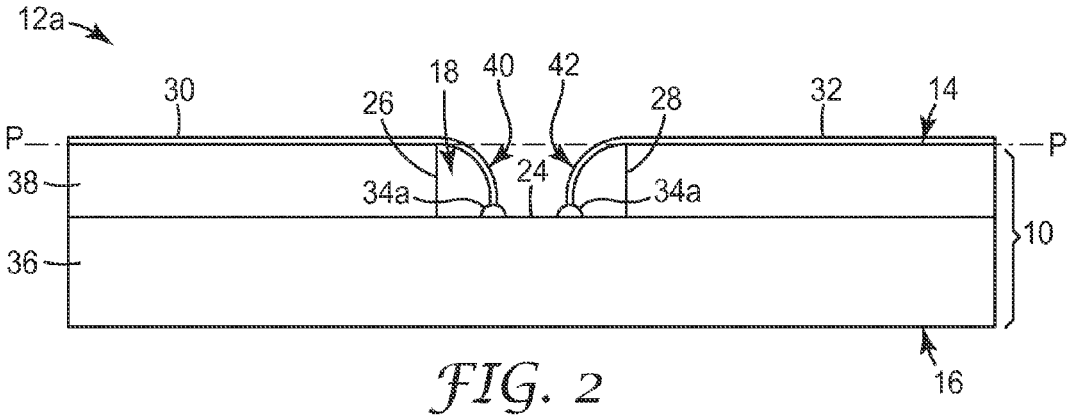
FIG. 2 is a cross-sectional view of a fixed abrasive article formed from the support pad of FIG. 1, taken along line A-A, with a first embodiment of a fixation mechanism in accordance with the present invention attached to the support pad.

FIG. 2 shows a cross-sectional view of a fixed abrasive article 12*a* formed from the support pad 10 of FIG. 1, taken along line A-A. The fixed abrasive article 12*a* includes the support pad 10, a first abrasive element 30, a second abrasive element 32 and a first embodiment of a fixation mechanism 34*a*. The support pad 10 is formed of a resilient element 36 and a rigid element 38. By "resilient element" is meant an element that supports the rigid element, elastically deforming in compression. By "rigid element" is meant an element that is of higher modulus than the resilient element and which deforms in flexure. The fixed abrasive elements 30 and 32 are positioned over the first major surface 14 of the support pad 10 with the rigid element 38 interposed between the resilient element 36 and the fixed abrasive elements 30 and 32. In the fixed abrasive articles 12 of the present invention, the rigid element 38 and the resilient element 36 are generally continuous with, and parallel to, the fixed abrasive elements 30 and 32, such that all of the elements 30, 32, 36 and 38 are substantially coextensive. Although not shown in FIG. 2, the resilient element 36 is typically attached to a platen of a machine for semiconductor wafer modification, with the fixed abrasive elements 30 and 32 contacting the semiconductor wafer. In addition, although the support pad 10 is depicted and discussed in FIG. 2 as being formed of a resilient element 36 and a rigid element 38, the support pad 10 can include any number of elements, including a single resilient element, without departing from the intended scope of the present invention.

The hardness and/or compressibility of the support pad elements 36 and 38 are selected to provide the desired grinding characteristics (i.e., cut rate, product life, wafer uniformity and workpiece surface finish) for the particular process. The choice of materials for the resilient and rigid elements 36 and 38 will thus vary depending on the compositions of the workpiece surface (i.e. wafer surface) and fixed abrasive elements 30 and 32, the shape and initial flatness of the workpiece surface, the type of apparatus used for modifying the workpiece surface (e.g., planarizing the surface), the pressures used in the modification process, etc. In addition, the materials for use in the resilient and rigid elements 36 and 38 are selected such that the fixed abrasive article 12 provides uniform material removal across the workpiece surface (i.e., uniformity), and good planarity on patterned wafers, which includes flatness (measured in terms of the Total Indicated Runout (TIR)), and dishing (measured in terms of the planarization ratio). The particular planarity values depend on the individual workpiece and the application for which it is intended, as well as the nature of subsequent processing steps to which the workpiece may be subjected.

The primary purpose of the resilient element 36 is to allow the fixed abrasive article 12 to substantially conform to the global topography of the surface of the workpiece while maintaining a uniform pressure on the workpiece. For example, a semiconductor wafer may have an overall shape with relatively large undulations or variations in thickness, which the fixed abrasive article 12 should substantially match. It is desirable to provide substantial conformance of the fixed abrasive article 12 to the global topography of the workpiece so as to achieve the desired level of uniformity after modification of the workpiece surface. Because the resilient element 36 undergoes compression during a surface modification process, its resiliency when compressed in the thickness direction is an important characteristic for achieving this purpose. The resiliency (i.e., the stiffness in compression and elastic rebound) of the resilient element is related to the modulus of the material in the thickness direction, and is also affected by its thickness.

The resilient materials suitable for use in the fixed abrasive article 12 can be selected from a wide variety of materials. Typically, the resilient material is an organic polymer, which can be thermoplastic or thermoset and may or may not be inherently elastomeric. The materials generally found to be useful resilient materials are organic polymers that are foamed or blown to produce porous organic structures, which are typically referred to as foams. Such foams may be prepared from natural or synthetic rubber or other thermoplastic elastomers such as polyolefins, polyesters, polyamides, polyurethanes, and copolymers thereof, for example. Suitable synthetic thermoplastic elastomers include, but are not limited to, chloroprene rubbers, ethylene/propylene rubbers, butyl rubbers, polybutadienes, polyisoprenes, EPDM polymers, polyvinyl chlorides, polychloroprenes, or styrene/butadiene copolymers. An example of a particularly suitable resilient material is a copolymer of polyethylene and ethyl vinyl acetate in the form of a foam. Resilient materials may also be of other constructions if the appropriate mechanical properties (e.g., Young's Modulus and remaining stress in compression) are attained. Polyurethane impregnated felt-based materials used in conventional polishing pads can be used, for example. The resilient material may also be a nonwoven or woven fiber mat of, for example, polyolefin, polyester, or polyamide fibers, which has been impregnated by a resin (e.g. polyurethane). The fibers may be of finite length (i.e., staple) or substantially continuous in the fiber mat. Specific resilient materials that are suitable in the fixed abrasive articles of the present invention include, but are not limited to, poly(ethylene-co-vinyl acetate) foams available under the trade designations CELLFLEX 1200, CELLFLEX 1800, CELLFLEX 2200, CELLFLEX 2200 XF (Dertex Corp., Lawrence, Mass.); 3M SCOTCH brand CUSHION-MOUNT Plate Mounting Tape 949 (a double-coated high density elastomeric foam tape available from 3M Company, St. Paul, Minn.); EMR 1025 polyethylene foam (available from Sentinel Products, Hyannis, N.J.); HD200 polyurethane foam (available from Illbruck, Inc., Minneapolis, Minn.); MC8000 and MC8000EVA foams (available from Sentinel Products); and SUBA IV Impregnated Nonwoven (available from Rodel, Inc., Newark, Del.).

The primary purpose of the rigid element 38 is to limit the ability of the fixed abrasive article 12 to substantially conform to the local features of the surface of the workpiece. For example, a semiconductor wafer typically has adjacent features of the same or different heights with valleys between, the topography to which the abrasive construction should not substantially conform. It is desirable to attenuate conformance of the fixed abrasive article 12 to the local topography of the workpiece so as to achieve the desired level of planarity of the workpiece (e.g., avoid dishing). The bending stiffness (i.e., resistance to deformation by bending) of the rigid element 38 is an important characteristic for achieving this purpose. The bending stiffness of the rigid element 38 is directly related to the in-plane modulus of the material and is affected by its thickness. For example, for a homogeneous material, the bending stiffness is directly proportional to its Young's Modulus times the thickness of the material raised to the third power.

Exemplary rigid materials include, but are not limited to: organic polymers, inorganic polymers, ceramics, metals, composites of organic polymers, and combinations thereof. Suitable organic polymers can be thermoplastic or thermoset. Suitable thermoplastic materials include, but are not limited to: polycarbonates, polyesters, polyurethanes, polystyrenes, polyolefins, polyperfluoroolefins, polyvinyl chlorides, and copolymers thereof. Suitable thermosetting polymers include, but are not limited to: epoxies, polyimides, polyesters, and copolymers thereof. As used herein, copolymers include polymers containing two or more different monomers (e.g., terpolymers, tetrapolymers, etc.). The organic polymers may or may not be reinforced. The reinforcement can be in the form of fibers or particulate material. Suitable materials for use as reinforcement include, but are not limited to, organic or inorganic fibers (continuous or staple), silicates such as mica or talc, silica-based materials such as sand and quartz, metal particulates, glass, metallic oxides, and calcium carbonate.

Metal sheets can also be used as the rigid element 38. Typically, because metals have a relatively high Young's Modulus (e.g., greater than about 50 GPa), very thin sheets are used (typically about 0.075-0.25 mm). Suitable metals include, but are not limited to, aluminum, stainless steel, and copper. Particularly suitable rigid materials include, but are not limited to: poly(ethylene terephthalate), polycarbonate, glass fiber reinforced epoxy boards (e.g., FR4, available from Minnesota Plastics, Minneapolis, Minn.), aluminum, stainless steel, and IC1000 (available from Rodel, Inc., Newark, Del.).

The resilient and rigid elements 36 and 38 of the abrasive constructions are typically separate layers of different materials. Each portion is typically one element of a material; however, each element 36 and 38 can include more than one layer of the same or different materials provided that the mechanical behavior of the layer is acceptable for the desired application. For example, the rigid element 38 can include elements of resilient and rigid materials arranged so as to give the required bending stiffness. Similarly, the resilient element 36 can include elements of resilient and rigid materials as long as the overall laminate has sufficient resiliency.

There may also be intervening layers of adhesive or other attachment means between the various components of the fixed abrasive article construction 12. For example, an adhesive element (e.g., a pressure sensitive adhesive) may be interposed between the rigid element 38 and the backings of the fixed abrasive elements 30 and 32. Although not shown in FIG. 2, there may also be an adhesive element interposed between the rigid element 38 and the resilient element 36, and on the surface of the resilient element 36. In addition, although FIG. 2 depicts the floor 24 of the channel 18 as being positioned where the resilient element 36 and the rigid element 38 meet, the floor 24 may be positioned at any point between the first and second major surfaces 14 and 16 of the support pad 10 as long as the fixation mechanism 34*a* is positioned below a plane of polishing P (below the first major surface 14 of the support pad 10 without departing from the intended scope of the present invention.

The fixed abrasive elements 30 and 32 include a plurality of abrasive particles affixed to a backing In general, the abrasive particles are dispersed in a binder to form an abrasive coating and/or abrasive composites bonded to the backing "Abrasive composite" refers to one of a plurality of shaped bodies which collectively provide a textured, three-dimensional abrasive element comprising abrasive particles and binder. "Textured" when used to describe a fixed abrasive element refers to a fixed abrasive element having raised portions and recessed portions. The abrasive particles may be homogeneously dispersed in the binder or alternatively the abrasive particles may be non-homogeneously dispersed. Generally, the abrasive particles are homogeneously dispersed so that the resulting abrasive coating provides a more consistent cutting ability. The first and second fixed abrasive elements 30 and 32 may include the same abrasive particles.

For semiconductor wafer planarization, fine abrasive particles are typically used. The average particle size of the abrasive particles can range from about 0.001 to 50 micrometers, typically between 0.01 to 10 micrometers. The particle size of the abrasive particle is typically measured by the longest dimension of the abrasive particle. In almost all cases there will be a range or distribution of particle sizes. In some instances the particle size distribution is tightly controlled such that the resulting abrasive article 12 provides a very consistent surface finish on the wafer after planarization.

The abrasive particles may also be in the form of an abrasive agglomerate which includes a plurality of individual abrasive particles bonded together to form a unitary particulate mass. The abrasive agglomerates may be irregularly shaped or have a predetermined shape. The abrasive agglomerates may utilize an organic binder or an inorganic binder to bond the abrasive particles together.

Examples of suitable abrasive particles include ceria (cerium oxide). fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles and the like. The alumina abrasive particle may contain a metal oxide modifier. Examples of alumina-based sol gel derived abrasive particles can be found in U.S. Pat. Nos. 4,314,827; 4,623,364; 4,744,802; 4,770,671; and 4,881,951, all incorporated herein by reference. The diamond and cubic boron nitride abrasive particles may be mono crystalline or polycrystal line. In the case of metal oxide-containing wafer surfaces (e.g., silicon dioxide-containing surfaces), ceria abrasive particles are useful. Ceria abrasive particles may be purchased from Rhone Poulenc; Shelton, Conn.; Transelco, N.Y.; Fujimi, Japan; Molycorp, Fairfield, N.J.; American Rar Ox, Chaveton City, Mass.; and Nanophase, Burr Ridge, Ill.

The fixed abrasive elements 30 and 32 may also contain a mixture of two or more different types of abrasive particles. For example, the mixture may include a mixture of "hard" inorganic abrasive particles and "soft" inorganic abrasive particles, or a mixture of two "soft" abrasive particles. "Hard" inorganic abrasive particles generally have a Mohs hardness of about 8 or greater and "soft" inorganic abrasive particles generally have a Mohs hardness less than about 8. In the mixture of two or more different abrasive particles, the individual abrasive particles may have the same average particle sizes, or may have different average particle sizes.

The binders for the fixed abrasive elements 30 and 32 of the present invention may be formed from an organic binder precursor. The binder precursor has a phase that is capable of flowing sufficiently so as to be coatable, and then solidifying. The solidification can be achieved by curing (e.g., polymerizing and/or crosslinking) and/or by drying (e.g., driving off a liquid), or simply upon cooling. The precursor can be an organic solvent-borne, water-borne, or 100% solids (i.e., a substantially solvent-free) composition. Both thermoplastic and thermosetting materials, as well as combinations thereof, can be used as the binder precursor.

The binder precursor is particularly a curable organic material (i.e., a material capable of polymerizing and/or crosslinking upon exposure to heat and/or other sources of energy, such as E-beam, ultraviolet, visible, etc., or with time upon the addition of a chemical catalyst, moisture, and the like). Binder precursor examples include amino resins (e.g., aminoplast resins) such as alkylated urea-formaldehyde resins, melamine-formaldehyde resins, and alkylated benzoguanamine-formaldehyde resin, acrylate resins (including acrylates and methacrylates) such as vinyl acrylates, acrylated epoxies, acrylated urethanes, acrylated polyesters, acrylated acrylics, acrylated polyethers, vinyl ethers, acrylated oils, and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins (including alkylalkoxysilane resins), reactive vinyl resins, and the like. The resins may be in the form of monomers, oligomers, polymers, or combinations thereof.

In one embodiment, the abrasive article may comprise pre-determined pattern of a plurality of precisely shaped abrasive composites comprising abrasive particles dispersed in a binder. "Precisely shaped abrasive composite" refers to an abrasive composite having a molded shape that is the inverse of the mold cavity which is retained after the composite has been removed from the mold; preferably, the composite is substantially free of abrasive particles protruding beyond the exposed surfaces of the shape before the abrasive article has been used, as described in U.S. Pat. No. 5,152,917 (Pieper et al.).

Suitable backings for the abrasive articles include both flexible backings and backings that are more rigid. The backing may be selected from a group of materials which have been used previously for abrasive articles, for example paper, nonwoven materials, cloth, treated cloth, polymeric film, primed polymeric film, metal foil, treated versions thereof, and combinations thereof. One preferred type of backing may be a polymeric film. Examples of such polymeric films include polyester films, co-polyester films, microvoided polyester films, polyimide films, polyamide films, polyvinyl alcohol films, polypropylene film, polyethylene film, and the like.

The thickness of the polymeric film backing generally may be from about 20 micrometers, preferably from about 50 micrometers, most preferably from about 60 micrometers; and may range to about 1,000 micrometers, more preferably to about 500 micrometers, and most preferably to about 200 micrometers. At least one surface of the backing may be coated with a matrix material and abrasive particles. In certain embodiments, the backing may be uniform in thickness. If the backing is not sufficiently uniform in thickness, greater variability in wafer polishing uniformity may result in the CMP process.

In practice, the backings of the first and second fixed abrasive elements 30 and 32 are generally coextensive with the first major surface 14 of the support pad 10 and are permanently attached to the support pad 10. The first abrasive element 30 is positioned over a first portion of the first major surface 14 of the support pad 10 created by the channel 18 such that an edge 40 of the first abrasive element 30 is positioned within the channel 18. Similarly, the second abrasive element 32 is positioned over a second portion of the first major surface 14 of the support pad 10 created by the channel 18 such that an edge 42 of the second abrasive element 32 is positioned within the channel 18. The fixed abrasive elements 30 and 32 can be attached to the support pad 10 by any means known in the art, including, but not limited to: adhesives, co-extrusion, thermal bonding, mechanical fastening devices, etc. Optionally, the fixed abrasive elements 30 and 32 do not need to be attached to the first major surface 14, but are at least maintained in a position immediately adjacent to it and coextensive with it. In this case some mechanical means of holding the fixed abrasive elements 30 and 32 in place during use will be required, such as placement pins, retaining ring, tension, vacuum, etc.

As can be seen in FIG. 2, the edges 40 and 42 of the first and second abrasive elements 30 and 32 are separately affixed within the channel 18. In particular, each of the edges 40, 42 is affixed to the floor 24 of the channel 18 using separate fixation mechanisms. The fixation mechanism 34*a* functions to attach the edges 40 and 42 of the first and second abrasive materials 30 and 32 to the channel 18 such that the edges 40 and 42 are firmly secured to the support pad 10 and can survive the rigors of polishing (e.g., set environment, heat generation and pressure). The edges 40 and 42 may be affixed to the support pad 10 by any fixation means known in the art. In the embodiment shown in FIG. 2, the edges 40 and 42 are bonded to the support pad 10. Other exemplary fixation means include, but are not limited to, a pressure sensitive adhesive, hook and loop attachment, a mechanical attachment or a permanent adhesive. Permanent adhesives include, but are not limited to, crosslinked polymeric adhesives, such as thermosetting resins, and adhesives that solidify upon cooling, such as hot melt adhesives. Useful thermosetting resins include e.g., polyesters and polyurethanes and hybrids and copolymers thereof including, e.g., acylated urethanes and acylated polyesters, amino resins (e.g., aminoplast resins) including, e.g., alkylated urea-formaldehyde resins, melamine-formaldehyde resin, acrylate resins including, e.g., acrylates and methacrylates, vinyl acrylates, acrylated epoxies, acrylated urethanes, acrylated polyesters, acrylated acrylics, acrylated polyethers, vinyl ethers, acrylated oils and acrylated silicones, alkyd resins such as urethane alkyd resins, polyester resins, reactive urethane resins, phenolic resins including, e.g., resole resins, novolac resins and phenol-formaldehyde resins, phenolic/latex resins, epoxy resins including, e.g., bisphenol epoxy resins, aliphatic and cycloaliphatic epoxy resins, epoxy/urethane resin, epoxy/acrylate resin and epoxy/silicone resin, isocyanate resins, isocyanurate resins, polysiloxane resins including alkylalkoxysilane resins, reactive vinyl resins and mixtures thereof. Resins useful as hot melt adhesives include polyesters, polyamides, polyurethanes, styrene block colpolymers, e.g. styrene-butadiene-styrene, styrene-isoprene-styrene and the like, polyolefins, e.g. polyethylene, polypropylene and the like including metallocene based polyolefins, silicones, polycarbonates, ethyl vinyl acetate, acrylate and methacrylate based polymers. Representative examples of suitable pressure sensitive adhesives include, but are not limited to: latex crepe, rosin, acrylic polymers and copolymers; for example, polybutylacrylate, polyacrylate ester, vinyl ethers; for example, polyvinyl n-butyl ether, alkyd adhesives, rubber adhesives; for example, natural rubber, synthetic rubber, chlorinated rubber and mixtures thereof.

Although the edges 40 and 42 of the fixed abrasive elements 30 and 32 are depicted in FIG. 2 as being affixed to the floor 24 of the channel 18, the edges 40 and 42 of the fixed abrasive elements 30 and 32 may be positioned anywhere within the channel 18 without departing from the intended scope of the present invention, as long as the edges 40 and 42 are attached below the plane of polishing P so that the edges 40 and 42 of the fixed abrasive elements 30 and 32 will not encounter the workpiece being polished. For example, the edges 40 and 42 of the fixed abrasive elements 30 and 32 may alternatively be affixed to one of the first and second side walls 26 and 28 of the channel 18. By simulating a splice between the first and second fixed abrasive elements 30 and

32 within the channel 18 and below the plane of polishing P, the level of defects on the workpieces being polished are minimized or eliminated.

During use, the surfaces of the fixed abrasive elements 30 and 32 contact the workpiece to modify the surface of the workpiece to achieve a surface that is more planar and/or more uniform and/or less rough than the surface prior to treatment. The underlying combination of the resilient and rigid elements 36 and 38 of the support pad 10 provides an abrasive construction that substantially conforms to the global topography of the surface of the workpiece (e.g., the overall surface of a semiconductor wafer) while not substantially conforming to the local topography of the surface of the workpiece (e.g., the spacing between adjacent features on the surface of a semiconductor wafer) during surface modification. As a result, the fixed abrasive article 12 will modify the surface of the workpiece in order to achieve the desired level of planarity, uniformity, and/or roughness. The particular degree of planarity, uniformity, and/or roughness desired will vary depending upon the individual workpiece and the application for which it is intended, as well as the nature of any subsequent processing steps to which the wafer may be subjected.

Figure 3:
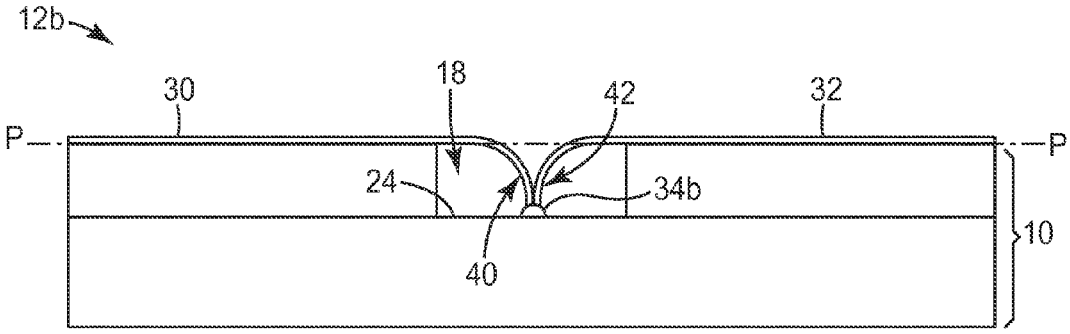
FIG. 3 is a cross-sectional view of a fixed abrasive article formed from the support pad of FIG. 1, taken along line A-A, with a second embodiment of a fixation mechanism in accordance with the present invention attached to the support pad.

FIG. 3 shows a cross-sectional view of a fixed abrasive article 12*b* formed from the support pad 10 of FIG. 1, taken along line A-A. The fixed abrasive article 12*b* includes the support pad 10, a first abrasive element 30, a second abrasive element 32 and a second embodiment of a fixation means 34*b*. The fixed abrasive article 12*a* shown in FIG. 3 is similar to the fixed abrasive article 12*a* shown in FIG. 2 except that the edges 40 and 42 of the first and second abrasive elements 30 and 32 are attached to the support pad 10 using a single fixation means. In the embodiment shown in FIG. 3, the edges 40 and 42 of the first and second abrasive elements 30 and 32 are affixed within the channel 18 in a single strip of bond. However, the edges 40 and 42 may be affixed to the support pad 10 by any fixation means known in the art. Other exemplary fixation means include those previously discussed relative to fixation mechanism 34*a* of FIG. 2.

As previously mentioned, although the edges 40 and 42 of the first and second abrasive elements 30 and 32 are depicted as being affixed to the floor 24 of the channel 18, the edges 40 and 42 may be affixed anywhere within the channel 18 without departing from the intended scope of the present invention as long as the edges 40 and 42 are attached below the plane of polishing P.

Figure 4:
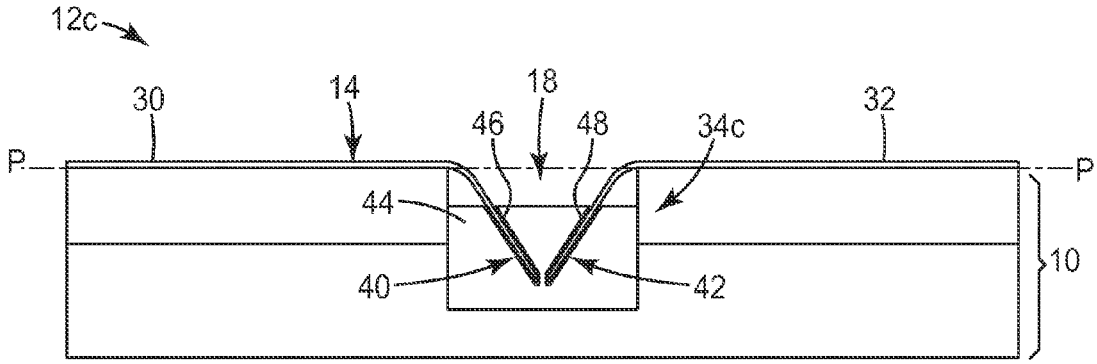
FIG. 4 is a cross-sectional view of a fixed abrasive article formed from the support pad of FIG. 1, taken along line A-A, with a third embodiment of a fixation mechanism in accordance with the present invention attached to the support pad.

FIG. 4 shows a cross-sectional view of a fixed abrasive article 12*c* formed from a support pad 10 similar to the support pad 10 shown in FIG. 1, taken along line A-A. The fixed abrasive article 12*c* includes a support pad 10, a first abrasive element 30, a second abrasive element 32 and a third embodiment of a fixation means 34*c*. The fixed abrasive article 12*c* shown in FIG. 4 functions similarly to the fixed abrasive articles 12*a* and 12*b* described in relation to FIGS. 2 and 3 except that the fixed abrasive elements 30 and 32 of the fixed abrasive article 12*c* of FIG. 4 is intended to be used in the form of an incrementing web or a roll, typically referred to in the abrasive art as abrasive rolls, rather than in the form of a discrete pad having a plate-like configuration. The abrasive roll may range in size from about 10 mm to 2000 mm wide, typically about 20 mm to 760 mm wide. Additionally, the abrasive roll can range in length from about 100 cm to 500, 000 cm, typically from about 500 cm to 2000 mc.

In general, the abrasive rolls will be indexed to achieve the desired planarization criteria. Indexing may occur between the planarization of two separate workpieces. Alternatively, indexing may occur during the planarization of one workpiece. If the latter occurs, the indexing speed will be set to achieve the desired planarization criteria. Indexing of conventional abrasive rolls is well known in the art. Thus, the abrasive roll is not attached to the support pad 10 and is designed to move incrementally along the first major surface 14 of the support pad 10 in the direction of the channel 18 from the first edge 20 of the support pad 10 to the second edge 22 of the support pad 10 (shown in FIG. 1).

The support pad 10 and the fixed abrasive elements 30 and 32 of the fixed abrasive article 12*c* depicted in FIG. 4 are similar in material and function to the support pad 10 and the fixed abrasive elements 30 and 32 shown in FIGS. 2 and 3. However, because the fixed abrasive elements 30 and 32 are part of incrementing webs, the fixation means 34*c* is different. The fixation means 34*c* includes a rigid block 44 positioned within the channel 18 of the support pad 10. The rigid block 44 includes a plurality of slits 46 and 48 designed to accept the edges 40 and 42 of the first and second abrasive elements 30 and 32 and temporarily maintain the edges 40 and 42 in position. Although FIG. 4 depicts the rigid block 44 as being rectangular in shape and including two slits 46 and 48, the rigid block 44 may take on any shape and include any number of slits without departing from the intended scope of the present invention, as long as the rigid block and the edges 40 and 42 of the fixed abrasive elements 30 and 32 remain below the plane of polishing P. In addition, although the rigid block 44 is depicted and discussed as including slits to maintain edges 40 and 42 of the first and second abrasive elements 30 and 32 below the plane of polishing P, any means of temporarily securing or maintaining edges of an article in a desired position can be used without departing from the intended scope of the present invention.

When the edges 40 and 42 are positioned within the slits 46 and 48, the edges 40 and 42 of the abrasive elements 30 and 32 are maintained below the plane of polishing P while the workpiece is being polished. To help maintain the remainder of the fixed abrasive elements 30 and 32 against the first major surface 14 of the support pad 10 during polishing, a vacuum, as is well known in the art, is applied. In configurations in which a vacuum is used, the platen surface is typically designed with holes, ports and/or channels to facilitate communication between the vacuum and the fixed abrasive article 12*c*. The vacuum is applied within the channel 18 as well as under the fixed abrasive elements 30 and 32 in order to ensure that the fixed abrasive elements 30 and 32 are being held down tightly, even in the area of the simulated splice. Upon completion of the polishing operation, the vacuum may be removed and the abrasive elements 30 and 32 can be moved forward, i.e., incremented a set amount, exposing a fresh region of abrasive. Optionally, any means known in the art of temporarily maintaining the fixed abrasive elements 30 and 32 against the support pad 10 during polishing can be used without departing from the intended scope of the present invention.

When the workpiece is not being polished, the vacuum is removed and the fixed abrasive elements 30 and 32 are advanced. The slits 46 and 48 allow the edges 40 and 42 of the fixed abrasive elements 30 and 32 to slide within the slits 46 and 48 such that the incrementing web can be advanced in the direction of the channel 18 and travel from the first edge 20 of the support pad 10 towards the second edge 22 of the support pad 10. When the fixed abrasive elements 30 and 32 have been advanced to the desired positions, the vacuum is reapplied to temporarily secure the fixed abrasive elements 30 and 32 to the support pad 10.

Figure 5:
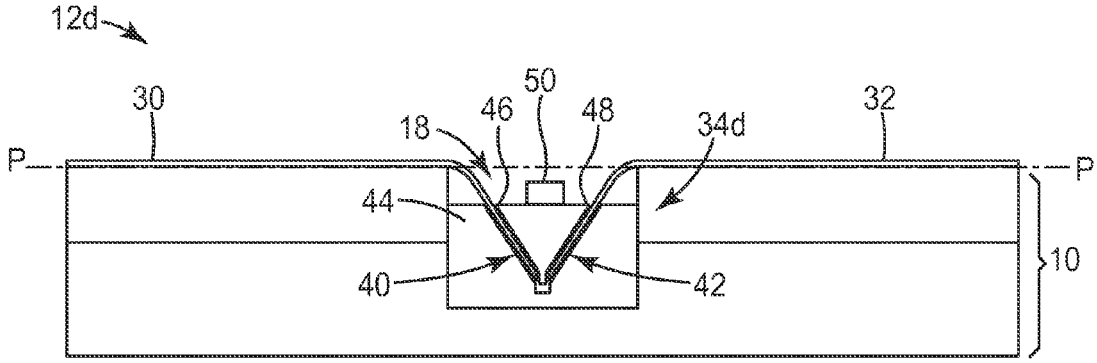
FIG. 5 is a cross-sectional view of a fixed abrasive article formed from the support pad of FIG. 1, taken along line A-A, with a fourth embodiment of a fixation mechanism in accordance with the present invention attached to the support pad.

FIG. 5 shows a cross-sectional view of a fixed abrasive article 12*d* formed from a support pad 10 similar to the support pad 10 shown in FIG. 1, taken along line A-A. The fixed abrasive article 12*d* includes the support pad 10, a first abrasive element 30, a second abrasive element 32 and a fourth embodiment of a fixation means 34*d*. The abrasive article 12*d* shown in FIG. 5 is also in the form of an abrasive roll and is similar in form, materials and function to the abrasive article 12*c* depicted in and discussed with reference to FIG. 4. The only exception is that the fourth embodiment of the fixation means 34*d* includes an additional element. While the fixation means 34*d* shown in FIG. 5 also includes a rigid block 44 having a plurality of slits 46 and 48, the edges 40 and 42 of the first and second abrasive elements 30 and 32 are attached to the support pad 10 using an additional clamp 50. The clamp 50 applies pressure on the edges 40 and 42 of the fixed abrasive elements 30 and 32 held in the slits 46 and 48 during polishing and then releases that pressure when the fixed abrasive elements 30 and 32 advance from the first edge 20 to the second edge 22 of the support pad 10 between polishing intervals. The clamp 50 thus functions similarly to the vacuum used in FIG. 4. Although a clamp is particularly mentioned as a means for selectively applying pressure on the edges 40 and 42 of the fixed abrasive elements 30 and 32 to maintain the edges 40 and 42 within the slits 46 and 48, any means for selectively applying pressure on the edges 40 and 42 can be used without departing from the intended scope of the present invention.

In one embodiment, the fixed abrasive elements 30 and 32 are maintained against the support pad 10 by a vacuum during polishing as described in the embodiment of FIG. 4. However, because the clamp 50 maintains the edges 40 and 42 of the abrasive elements 30 and 32 within the slits, the vacuum may be applied only along the first major surface 14 of the support pad 10 and is not necessarily applied in the channel 18.

The fixed abrasive articles of the present invention can be used to polish or planarize a workpiece, such as a semiconductor wafer for example, during chemical mechanical planarization. The fixed abrasive articles minimize defects on the surface of the workpiece caused by contact with the rough edges of the fixed abrasive elements.

Although the present invention has been described with reference to preferred embodiments, workers skilled in the art will recognize that changes may be made in form and detail without departing from the spirit and scope of the invention.

What is claimed is:

1. An abrasive article comprising:

a support pad having a first major surface, a second major surface, a first edge, a second edge and a channel, wherein the channel is formed within the first major surface and extends from the first edge to the second edge;

a first abrasive element positionable over a portion of the support pad;

a second abrasive element positionable over a portion of the support pad; and a fixation mechanism positioned within the channel for securing an edge of the first abrasive element and an edge of the second abrasive element to the support pad.

2. The abrasive article of claim 1, wherein the edges of the first and second abrasive elements are secured to the support pad by separate fixation mechanisms.

3. The abrasive article of claim 1, wherein the edges of the first and second abrasive elements are secured to the support pad by a single fixation mechanism.

4. The abrasive article of claim 1, wherein the fixation mechanism comprises:

a rigid material having a plurality of slits; and a mechanism to maintain the edge of the first abrasive element within one of the slits.

5. The abrasive article of claim 4, wherein the mechanism to maintain the edge of the first abrasive element within one of the slits comprises one of a vacuum and a clamp.

6. The abrasive article of claim 1, wherein the fixation mechanism comprises one of a pressure sensitive adhesive, a hook and loop attachment, a mechanical attachment or a permanent adhesive.

7. A fixed abrasive article comprising:

a pad having a first major surface and a second major surface;

a first abrasive element positionable over a portion of the first major surface;

a second abrasive element positionable over a portion of the first major surface; and a fixation mechanism located below a plane defined by the first major surface, wherein the fixation mechanism attaches an edge of the first abrasive element and an edge of the second abrasive element to the pad.

8. The fixed abrasive article of claim 7, wherein the first major surface includes a channel within the first major surface defining a floor, a first side wall and a second side wall.

9. The fixed abrasive article of claim 7, wherein the edges of the first and second abrasive elements are attached to the pad by separate fixation mechanisms.

10. The fixed abrasive article of claim 7, wherein the edges of the first and second abrasive elements are attached to the pad by a single fixation mechanism.

11. The fixed abrasive article of claim 8, wherein the fixation mechanism attaches the edges of the first and second abrasive elements within the channel.

12. The fixed abrasive article of claim 8, wherein the fixation mechanism comprises one of a pressure sensitive adhesive, a hook and loop attachment, a mechanical attachment or a permanent adhesive.

13. The fixed abrasive article of claim 7, wherein the fixation mechanism comprises:

a block having a first slit and a second slit; and a mechanism to maintain the edge of the first abrasive element within the first slit and the edge of the second abrasive element within the second slit.

14. The fixed abrasive article of claim 13, wherein the mechanism to maintain the edges of the first and second abrasive elements within the first and second slits, respectively, comprises one of a vacuum and a clamp.

15. A method of polishing a surface of a workpiece comprising:

providing a support pad having a first major surface, a first edge, a second edge, and a channel located within the first major surface extending from the first edge to the second edge;

covering a portion of the first major surface of the support pad with a first abrasive element;

positioning an edge of the first abrasive element within the channel of the support pad;

covering a portion of the first major surface of the support pad with a second abrasive element;

positioning an edge of the second abrasive element within the channel of the support pad;

maintaining the edges of the first and second abrasive elements within the channel;

contacting the first and second abrasive elements with the surface of the workpiece; and moving the workpiece and the fixed abrasive elements with respect to each other.

16. The method of claim 15, further comprising incrementally advancing the first and second abrasive elements from the first edge toward the second edge of the support pad.

17. The method of claim 15, wherein maintaining the edges of the first and second abrasive elements within the channel comprises one of a vacuum and a clamp.

18. The method of claim 15, wherein maintaining the edges of the first and second abrasive elements within the channel comprises bonding the edges within the channel.

19. The method of claim 18, wherein bonding the edges within the channel comprises using one of a pressure sensitive adhesive, a hook and loop attachment, a mechanical attachment or a permanent adhesive.

20. The method of claim 15, wherein positioning the edges of the first and second abrasive elements within the channel comprises inserting the edges into a rigid block.

* * * * *